US006961028B2

(12) United States Patent
Joy et al.

(10) Patent No.: US 6,961,028 B2
(45) Date of Patent: Nov. 1, 2005

(54) LOW PROFILE DUAL FREQUENCY DIPOLE ANTENNA STRUCTURE

(75) Inventors: Philip Joy, Garland, TX (US); Harold D. Reasoner, Fort Worth, TX (US)

(73) Assignee: Lockheed Martin Corporation, Bethesada, MD (US)

( * ) Notice: Subject to any disclaimer, the term of this patent is extended or adjusted under 35 U.S.C. 154(b) by 279 days.

(21) Appl. No.: 10/346,895

(22) Filed: Jan. 17, 2003

(65) Prior Publication Data

US 2004/0140941 A1 Jul. 22, 2004

(51) Int. Cl.[7] ..... H01Q 1/36
(52) U.S. Cl. ..... 343/895; 343/795; 343/803
(58) Field of Search ..... 343/895, 795, 343/803, 817, 821, 725, 726, 727

(56) References Cited

U.S. PATENT DOCUMENTS

| | | | | |
|---|---|---|---|---|
| 4,038,662 | A | 7/1977 | Turner | 343/752 |
| 4,495,505 | A | 1/1985 | Shields | |
| 4,825,220 | A | 4/1989 | Edward et al. | |
| 4,870,426 | A | 9/1989 | Lamberty et al. | |
| 5,892,486 | A | 4/1999 | Cook et al. | |
| 5,917,456 | A | 6/1999 | Teunisse | |
| 5,949,383 | A | 9/1999 | Hayes et al. | |
| 5,999,141 | A | * 12/1999 | Weldon | 343/803 |
| 6,018,324 | A | 1/2000 | Kitchener | |
| 6,317,099 | B1 | 11/2001 | Zimmerman et al. | |
| 6,339,405 | B1 | 1/2002 | Gleener | |
| 6,535,179 | B1 | * 3/2003 | Petros | 343/895 |
| 2002/0084993 | A1 | 7/2002 | Shinichi | 342/702 |

FOREIGN PATENT DOCUMENTS

| | | |
|---|---|---|
| EP | 1 032 076 A2 | 8/2000 |
| WO | WO 02/095875 A1 | 11/2002 |
| WO | PCT/USO3/21018 | 1/2004 |

OTHER PUBLICATIONS

Faton Tefiku, et al., "Design of Broad–Band and Dual–Band Antennas Comprised of Series–Fed Printed–Strip Dipole Pairs," IEEE Transactions on Antennas and Propagation, vol. 48, No. 6, Jun. 2000, pp. 895–900.

* cited by examiner

*Primary Examiner*—Wilson Lee
(74) *Attorney, Agent, or Firm*—James L. Baudino; Munsch, Hardt Kopf & Harr, P.C.

(57) ABSTRACT

An antenna includes a first dipole having first and second stripline radiating elements extending in opposite directions from a central feed point and along a generally rectangular outline of the antenna. The first dipole is operable to be resonant at a first frequency. The antenna also includes a second dipole having third and fourth stripline radiating elements extending in opposite directions from the central feed point and generally parallel to the first and second stripline radiating elements. The third and fourth stripline radiating elements generally follow and stay within the rectangular antenna outline. The second dipole is operable to be resonant at a second frequency. The antenna also includes a stripline balun electrically coupled to the central feed point and extending generally parallel with the first and second dipoles and along the rectangular antenna outline.

30 Claims, 1 Drawing Sheet

LOW PROFILE DUAL FREQUENCY DIPOLE ANTENNA STRUCTURE

TECHNICAL FIELD OF THE INVENTION

This invention relates to antenna structures, and more particularly, to a low profile dipole antenna structure.

BACKGROUND OF THE INVENTION

The length of a dipole antenna is related to its operating frequency. A dipole antenna typically has two radiating elements having a common center feed point. The length of the combined dipole radiating elements is typically a multiple of the transmitting or receiving frequency. For example, the dipole radiating elements may have a length that is ¼, ½, or ¾ the wavelength of the radio frequency (RF) energy. In order to operate in two frequency bands, the antenna structure must have two sets of dipole radiating elements with two different lengths.

In certain applications, such as in an instrument landing system (ILS) of an aircraft, a dual-frequency dipole antenna is used to receive the radio frequencies of the glide slope and localizer radio frequency transmissions. In these applications, the antenna is typically mounted inside the nose cone of the aircraft where space is severely limited. Therefore, it is desirable to provide a dual-frequency dipole antenna that will fit within the confines of available space and not interfere with other equipment on board the aircraft.

SUMMARY OF THE INVENTION

In accordance with an embodiment of the present invention, an antenna includes a first dipole having first and second stripline radiating elements extending in opposite directions from a central feed point and along a generally rectangular outline of the antenna. The first dipole is operable to be resonant at a first frequency. The antenna also includes a second dipole having third and fourth stripline radiating elements extending in opposite directions from the central feed point and generally parallel to the first and second stripline radiating elements. The third and fourth stripline radiating elements generally follow and stay within the rectangular antenna outline. The second dipole is operable to be resonant at a second frequency. The antenna also includes a stripline balun electrically coupled to the central feed point and extending generally parallel with the first and second dipoles and along the rectangular antenna outline.

In accordance with another embodiment of the present invention, an antenna structure comprises a generally rectangular outline having a width, W, and a length, L, and a center axis bisecting the length of the rectangular outline, and a central feed point lying on the center axis of the rectangular outline. The antenna structure includes a first dipole coupled to the central feed point having first and second radiating elements extending opposite one another along the length of the rectangular outline for a total length less than L. The antenna also includes a second dipole coupled to the central feed point having third and fourth radiating elements extending opposite one another along the length of the rectangular outline for a length equal to L. The third and fourth radiating elements further include short perpendicular segments extending along the width of the rectangular outline operable to extend a total length of third and fourth radiating elements to a predetermined desired length. The third and fourth radiating elements generally stay within the rectangular outline. The antenna structure further includes a balun coupled to the central feed point having a length equal to L.

In accordance with yet another embodiment of the present invention, a method of forming an antenna structure comprises defining a generally rectangular outline having a width, W, and a length, L, and a center axis bisecting the length of the rectangular outline, and providing a central feed point lying on the center axis of the rectangular outline. The method includes forming a first dipole coupled to the central feed point having first and second radiating elements extending opposite one another along the length of the rectangular outline for a total length less than L. The method also includes forming a second dipole coupled to the central feed point having third and fourth radiating elements extending opposite one another along the length of the rectangular outline for a length equal to L. The third and fourth radiating elements include short perpendicular segments extending along the width of the rectangular outline that are operable to extend a total length of the third and fourth radiating elements to a predetermined desired length. The third and fourth radiating elements generally stay within the rectangular outline. The method further includes forming a balun coupled to the central feed point having a length equal to L.

BRIEF DESCRIPTION OF THE DRAWINGS

For a more complete understanding of the present invention, the objects and advantages thereof, reference is now made to the following descriptions taken in connection with the accompanying drawings in which.

DETAILED DESCRIPTION OF THE INVENTION

Figure 1:
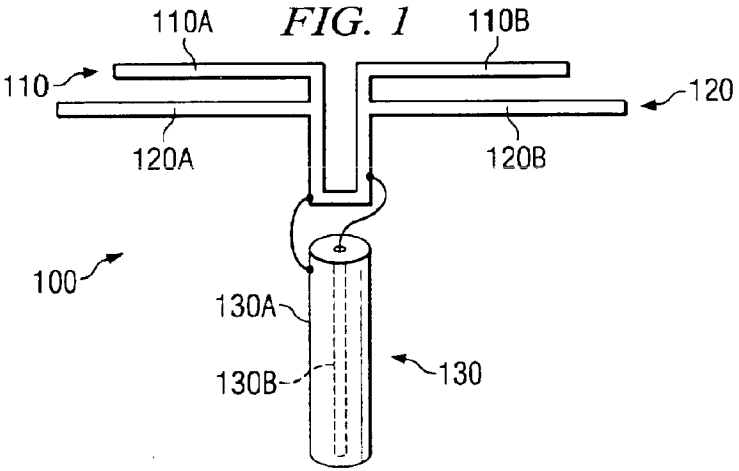
FIG. 1 is a schematic of a conventional dual-band antenna structure comprised of two dipoles.
Figure 2:
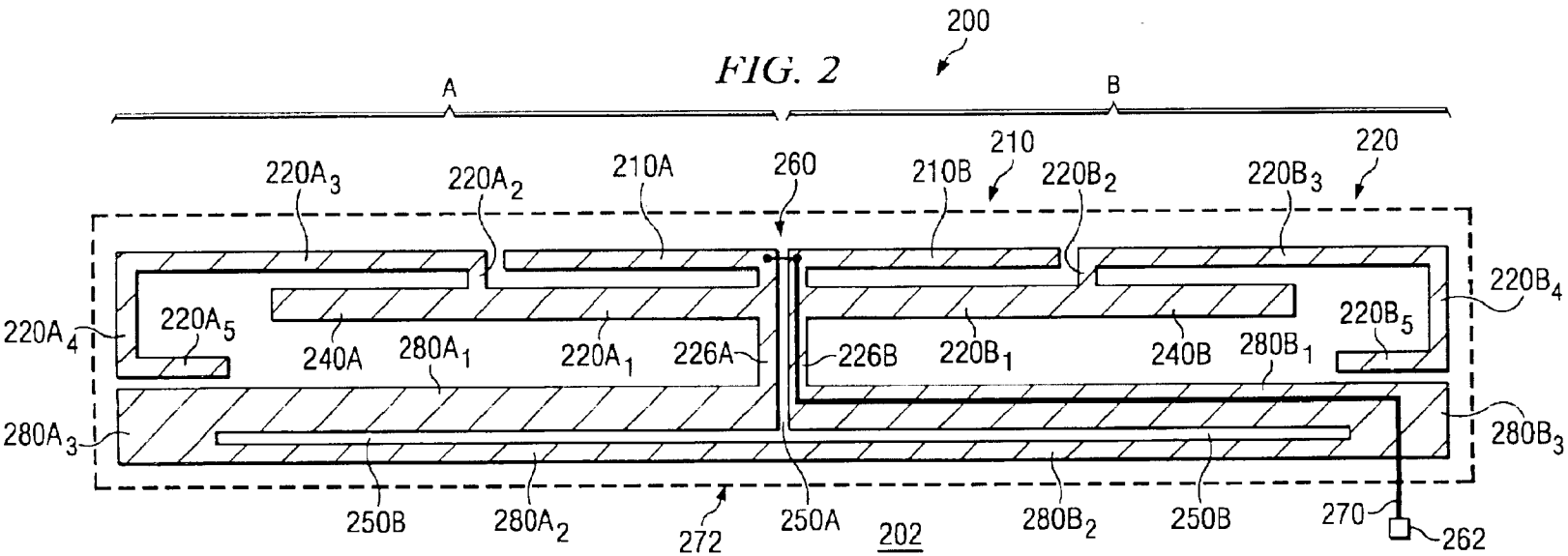
FIG. 2 is a top plan view of a dual-frequency dipole antenna structure having a first dipole and a second dipole according to an embodiment of the present invention.

The preferred embodiment of the present invention and its advantages are best understood by referring to FIGS. 1 and 2 of the drawings, like numerals being used for like and corresponding parts of the various drawings.

A multi-band dipole antenna may be formed by coupling a plurality of parallel dipoles to a common feed system. A center-fed dipole antenna provides a low impedance at the dipole resonant frequency and high impedances at other non-harmonic frequencies. Thus, a plurality of center-fed dipoles may be coupled to a common feed point to form a multi-band dipole antenna system. Each dipole may be constructed to resonate at a particular frequency $\lambda$.

FIG. 1 is a simplified schematic diagram of a conventional dual-band antenna system 100 having two dipoles. A first dipole antenna 110 having a resonant frequency $f_{o1}$ of wavelength $\lambda_1$ is comprised of two radiating elements 110A and 110B of length $\lambda_1/4$, respectively. A second dipole 120 having a resonant frequency of $f_{02}$ of wavelength $\lambda_2$ comprises two radiating elements 120A and 120B of length $\lambda_2/4$, respectively. Each dipole 110 and 120 is a center-fed dipole antenna and share a common feed point. In the illustrative example, dipole radiating elements 110A and 120A are coupled to an outer shield 130A of coaxial cable 130, and dipole radiating elements 110B and 120B are coupled to an inner conductor 130B of a coaxial cable 130. Each dipole antenna 110 and 120 provides a low feed-point impedance at respective resonant frequency $f_{o1}$ and $f_{o2}$ (and odd harmonics thereof), and higher impedances at other operational frequencies. When one dipole antenna of a multi-dipole antenna system 100 is resonant, the other dipole provides a higher impedance than the lower-impedance resonating dipole. Thus, the resonating dipole is the natural path for the majority of power flowing through the antenna system.

In practicality, however, parallel coupled dipoles in near proximity with one another may be electrically coupled via mutual inductance therebetween. Mutual inductance may increase the resonant length, e.g. $\lambda_2$, of the shorter dipole in a parallel dipole antenna system and may also reduce the operational bandwidth of the shorter dipole 110. Dipoles 110 and 120 may be implemented in a configuration that provides greater separation to enhance the antenna system operation. However, when the available physical confines to accommodate the antenna system are restricted, the afore-described problems may be exacerbated.

With reference now to FIG. 2 a top plan view of a dual-frequency center-fed dipole antenna structure 200 constructed according to an embodiment of the present invention is shown. Antenna structure 200 includes conductive traces or stripline on a printed circuit board (PCB) that is etched, laid down or otherwise formed on a dielectric or non-conductive substrate 202. For example, antenna structure 200 may be formed by pattern etching a copper-plated sheet of synthetic material. Antenna 200 has a first dipole 210 and a second dipole 220 located proximate with one another. First dipole 210 has a first resonant frequency $f_{o1}$ corresponding to a first resonant wavelength of $\lambda_1$. Second dipole 220 has a second resonant frequency $f_{o2}$ corresponding to a second resonant wavelength of $\lambda_2$. Therefore, dipole antenna 210 is operable to receive and/or transmit electromagnetic radiation in a first frequency bandwidth, and dipole antenna 220 is operable to receive and/or transmit electromagnetic radiation in a second frequency bandwidth.

The dipole antennas are generally symmetrical along a center axis 212. Dipole 210 is shown having a linear configuration having radiating elements 210A and 210B with a combined length $\lambda_1/2$ or $L_1$, and is resonant at a frequency $f_{o1}$. Dipole 220 may be constructed from multiple straight dipole segments 220$A_1$–220$A_5$ and 220$B_1$–220$B_5$. It may be seen that in the embodiment shown in FIG. 2, dipole segments 220$A_1$–220$A_5$ and 220$B_1$–220$B_5$ are generally coupled to neighboring segments at 90° angles and generally confined within a predetermined rectangular outline 272. The radiating elements of dipole 220 are thus bent around the radiating elements of dipole 210 with the dipole segments with a predetermined spacing therebetween. For example, dipole segment 220$B_2$ is used to turn the direction of radiating element 220B 90° around the end of radiating element 210B and toward the edge of the rectangular outline; dipole segment 220$B_3$ then turns the direction of radiating element 220B another 90° down the first axis or length of antenna structure 200 adjacent to the rectangular outline; dipole segment 220$B_4$ then turns the direction of the radiating element 220B another 90° down the second axis or width of antenna structure 200; and dipole segment 220$B_5$ then turns the direction of the radiating element 220B another 90° back toward the center of the dipole antenna along the first axis. Rectangular outline 272 is compact and limits antenna structure 200 to a predetermined generally rectangular footprint. It may also be seen that an effort has been made to obtain the correct length for dipole 220 while accommodating the real estate occupied by radiating elements of dipole 210.

Antenna structure 200 further comprises a unique balun 250. Balun 250 is preferably of a compact stripline construction that provides a balanced and high-impedance feed to the antenna. Balun 250 is designed based on the center frequency of the two antenna frequencies (¼ wave length of the center frequency). Balun 250 may be constructed of balun stripline segments 226A coupled to radiating elements 210A and 220A of the respective first and second dipoles, extending perpendicularly with respect to the antenna radiating elements, and coupled to another balun segment 280$A_1$, substantially parallel with the antenna radiating elements, a shorter balun segment 280$A_3$ perpendicular to the radiating elements, and then another balun segment 280$A_2$ parallel with the radiating elements. Balun segment 280$A_2$ is in turn coupled to a balun segment 280$B_2$, its symmetrical counterpart on the B side of the antenna. Segment 280$B_2$ which is coupled to 280$B_3$ and 280$B_1$. Balun 250 comprises the inverse T shaped channel formed between these stripline segments. It may be seen that balun 250 comprises two main channel portions 250A and 250B. Balun channel portion 250A is a channel formed generally perpendicularly with respect to the dipole radiating elements. In the embodiment of the present invention, the channel is approximately 0.16" in width. Balun portion 250B is a channel formed substantially parallel with respect to the dipole radiating elements. In the embodiment of the present invention, the channel is approximately 0.25" wide and 31.6" long. Balun portion 250A and 250B thus comprise a continuous channel formed by the stripline and has a resulting configuration of an inverted T. It may be seen that the primary length of the balun is in balun portion 250B which spans nearly the width of antenna 200. It may be seen that the stripline forming balun 250 has substantially the same width, $L_2$, as the second dipole, and substantially fills in the rectangular antenna outline not already occupied by the first and second dipole antennas. The unique design of balun 250 enables common feed point 260 to be located in close proximity to ground plane 270 while still presenting a balanced, high impedance path to ground from the feed point. Therefore, antenna structure 200 may be formed on a substrate that is planar or one that has some curvature such as the surface of a radome (not shown) on an aircraft. The low profile of antenna structure 200 also enables it to be installed near an edge of the radome without interfering with other radar antennas located nearby.

In the exemplary configuration, dipole segments 220$A_4$, 220$A_5$, 220$B_4$, and 220$B_5$ are each of length L. Thus, dipole 220 has a half-wave resonance length $\lambda_2/2$ or ($L_2$+4L). In the illustrated embodiment, dipole 210 has a half-wavelength $\lambda_1/2$ chosen for resonance at a frequency $f_{o1}$ that is an odd multiple of a resonance frequency $f_{o2}$ of dipole antenna 220. In an embodiment of the present invention, dipole antenna 210 is resonant at a third harmonic of dipole antenna 220. In other words, dipole antenna 210 has a frequency that is three-times the frequency of dipole antenna 220. $L_2$ is therefore approximately three-times the length of the sum of ($L_2$+4L). Both dipole antennas 210 and 220 are electrically coupled to a feed line 262 at a common feed point 260. Feed line 262 has an inner conductor that is soldered or otherwise electrically coupled to the A side of dipole antennas 210 and 220 (radiating segment 210A and 220$A_1$–220$A_5$), and an outer conductor insulated from the inner conductor that is soldered or otherwise electrically coupled to the B side of the dipole antennas (radiating segments 210B and 220$B_1$–220$B_5$). The outer conductor is further electrically coupled ground, thus forming a ground plane 270 in the B side of the dipole antennas as well as striplines 280$B_1$–280$B_3$ that form the B side of balun portion 250B. The outer conductor of feed line 262 may be soldered at various points to striplines 280$B_1$, 280$B_2$, and/or 280$B_3$.

Decoupling elements 240A and 240B are coupled to dipole sections 220A and 220B, respectively. More specifically, decoupling element 240A is coupled to radiating segment 220$A_1$ and extends in the same general direction thereof; and decoupling element 240B is coupled to radiating segment 220$B_1$ and extends in the same general direction thereof. Decoupling elements 240A and 240B are operable to prevent dipole antenna 220 from resonating at $f_{o1}$ and detuning dipole 210. For example, decoupling elements 240A and 240B eliminate the interaction between the two dipoles when there is a three-to-one frequency relationship therebetween. Therefore, decoupling elements 240A and 240B are operable to direct the radio frequency energy to the proper dipole and minimize the interaction between the dipole elements. In the absence of decoupling elements 240A and 240B, dipole 220 would resonate at odd harmonics of $f_{o2}$, for example at $f_{o1}$, and would be coupled with dipole 210 during concurrent resonance with dipole 210. Decoupling elements 240$A_1$ and 240$B_1$ are approximately $\lambda_1/4$ in length, and thereby effectively short dipole sections 220$A_1$, and 220$B_1$, when antenna structure 200 operates at $3\lambda_2/4$ (and harmonics thereof). Therefore, the unique design of decoupling elements 240A and 240B "decouples" the two dipole antennas from one another so as to eliminate interference therebetween.

For the purpose of providing an illustrative example, certain exemplary dimensions and characteristics according to an embodiment of the present invention are provided below:

| Dimension/Characteristic | Measurement |
|---|---|
| Antenna footprint width | 4" |
| Antenna footprint length | 36" |
| $L_1$ | 14.1" |
| $L_2$ | 30.4" |
| L | 2.5" |
| Width of decoupling element | 0.5" |
| Spacing between dipole radiating elements | 0.25" |
| Spacing between dipole radiating element and balun | 0.25" |
| $f_{01}$ | 330 MHz |
| $f_{02}$ | 110 MHz |

The stripline balun and dipole elements may be constructed in an integrated assembly with a low profile and small, limited footprint. The entire structure may be etched or formed on a PCB that may be flat or have some curvature. The low profile and limited footprint of antenna structure 200 due to the unique balun and decoupling element designs allow the antenna to be installed in confined spaces without interfering with radiating elements of other structures. For example, in certain applications such as in an instrument landing system (ILS) of an aircraft, antenna structure 200 may be installed on the surface of a radome located in the confined space of the nose cone of the aircraft. Antenna structure 200 would be used to receive the radio frequencies of the glide slope and localizer radio frequency transmissions from a landing site. Therefore, the low profile and limited footprint of antenna structure 200 makes it enable it to fit within the confines of available space and also not interfere with other radar equipment on board the aircraft.

While the invention has been particularly shown and described by the foregoing detailed description, it will be understood by those skilled in the art that various changes, alterations, modifications, mutations and derivations in form and detail may be made without departing from the spirit and scope of the invention.

What is claimed is:

1. An antenna, comprising:

first dipole having first and second stripline radiating elements extending in opposite directions from a central feed point and along a first side of a generally rectangular outline of the antenna, the first dipole operable to be resonant at a first frequency;

second dipole having third and fourth stripline radiating elements extending in opposite directions from the central feed point and generally parallel to the first and second stripline radiating elements, the third and fourth stripline radiating elements generally following and staying within the rectangular antenna outline, and the second dipole operable to be resonant at a second frequency; and a balun have a plurality of stripline segments and electrically coupled between the central feed point and a ground and extending generally parallel with the first and second dipoles and along the rectangular antenna outline.

2. The antenna, as set forth in claim 1, further comprising first and second decoupling elements coupled respectively to third and fourth stripline radiating elements.

3. The antenna, as set forth in claim 2, wherein the first and second decoupling elements generally extending along the first axis of the rectangular antenna outline.

4. The antenna, as set forth in claim 1, wherein the third stripline radiating element of the second dipole comprises:

first segment having a first predetermined length and extending from the central feed point parallel to the first stripline radiating element of the first dipole and terminating generally immediately beyond the first stripline radiating element of the first dipole;

second segment having a second predetermined length and coupled to the first segment at 90° thereto and extending perpendicular to the first segment toward the first side of the rectangular antenna outline;

third segment having a third predetermined length and coupled to the second segment at 90° thereto and extending along the first side of the rectangular antenna outline away from the central feed point and terminating at a second side of the rectangular antenna outline;

fourth segment having a fourth predetermined length coupled to the third segment at 90° thereto and extending perpendicularly to the third segment along the second side of the rectangular antenna outline and terminating proximate to the stripline balun;

fifth segment having a fifth predetermined length coupled to the fourth segment at 90° thereto and extending perpendicularly to the fourth segment toward the central feed point; and the first through fifth predetermined lengths of the first through fifth segments total length equal to $\lambda_2/4$, where $\lambda_2$ is the resonant wavelength of the second dipole.

5. The antenna, as set forth in claim 1, wherein the fourth stripline radiating element of the second dipole comprises:

first segment having a first predetermined length and extending from the central feed point parallel to the first stripline radiating element of the first dipole and terminating generally immediately beyond the first stripline radiating element of the first dipole;

second segment having a second predetermined length and coupled to the first segment at 90° thereto and extending perpendicular to the first segment toward the first side of the rectangular antenna outline;

third segment having a third predetermined length and coupled to the second segment at 90° thereto and extending along a first side of the rectangular antenna outline away from the central feed point and terminating at a third side of the rectangular antenna outline;

fourth segment having a fourth predetermined length coupled to the third segment at 90° thereto and extending perpendicularly to the third segment along the third side of the rectangular antenna outline and terminating proximate to the stripline balun;

fifth segment having a fifth predetermined length coupled to the fourth segment at 90° thereto and extending perpendicularly to the fourth segment toward the central feed point; and the first through fifth predetermined lengths of the first through fifth segments total length equal to $\lambda_2/4$, where $\lambda_2$ is the resonant wavelength of the second dipole.

6. The antenna, as set forth in claim 1, wherein the third and fourth stripline radiating elements of the second dipole generally following the rectangular antenna outline and bending at 90° to follow the rectangular antenna outline if necessary.

7. The antenna, as set forth in claim 1, wherein the third stripline radiating element is a mirror image of the fourth stripline radiating element along the central feed point.

8. The antenna, as set forth in claim 1, wherein the antenna is symmetrical along a central axis at the central feed point bisecting the first and second dipoles.

9. The antenna, as set forth in claim 1, wherein the balun comprises:

a generally rectangular circuitous configuration coupled at one end to first and third radiating elements of the respective first and second dipoles, and second end to second and fourth radiating elements of the respective first and second dipoles; and a channel formed by the balun stripline segments.

10. The antenna, as set forth in claim 9, wherein the balun is located proximate to the first and second dipoles within the generally rectangular antenna outline.

11. The antenna, as set forth in claim 1, wherein the balun comprises:

a first balun channel section extending generally perpendicularly to the first and second dipole radiating elements from the common feed point; and a second balun channel section coupled to the first balun channel section, the second balun channel section extending generally parallel with the first and second dipole radiating elements.

12. An antenna structure, comprising:

a generally rectangular outline having a width, W, and a length, L, and a center axis bisecting the length of the rectangular outline;

a central feed point lying on the center axis of the rectangular outline;

first dipole coupled to the central feed point having first and second radiating elements extending opposite one another along the length of the rectangular outline for a total length less than L;

second dipole coupled to the central feed point having third and fourth radiating elements extending opposite one another along the length of the rectangular outline for a length equal to L, the third and fourth radiating elements further comprising short perpendicular segments extending along the width of the rectangular outline operable to extend a total length of third and fourth radiating elements to a predetermined desired length, the third and fourth radiating elements generally staying within the rectangular outline; and a balun formed by stripline segments coupled to the central feed point, the balun stripline segments forming a narrow channel having a generally inverse T configuration.

13. The antenna structure, as set forth in claim 12, further comprising first and second decoupling elements coupled respectively to third and fourth radiating elements.

14. The antenna structure, as set forth in claim 13, wherein the first and second decoupling elements generally extending along the length of the rectangular outline.

15. The antenna structure, as set forth in claim 12, wherein the third radiating element of the second dipole comprises:

first segment having a first predetermined length and extending from the central feed point parallel to and adjacent the first radiating element of the first dipole and terminating generally immediately beyond the first radiating element of the first dipole;

second segment having a second predetermined length and coupled to the first segment at 90° thereto and extending perpendicular to the first segment toward the rectangular outline;

third segment having a third predetermined length and coupled to the second segment at 90° thereto and extending along a first side of the rectangular outline away from the central feed point and terminating at a second side of the rectangular outline;

fourth segment having a fourth predetermined length coupled to the third segment at 90° thereto and extending perpendicularly to the third segment along the second side of the rectangular antenna outline and terminating proximate to the balun;

fifth segment having a fifth predetermined length coupled to the fourth segment at 90° thereto and extending perpendicularly to the fourth segment toward the central feed point; and the first through fifth predetermined lengths of the first through fifth segments total length equal to $\lambda_2/4$, where $\lambda_2$ is the resonant wavelength of the second dipole.

16. The antenna structure, as set forth in claim 12, wherein the fourth stripline radiating element of the second dipole comprises:

first segment having a first predetermined length and extending from the central feed point parallel to and adjacent the first radiating element of the first dipole and terminating generally immediately beyond the first radiating element of the first dipole;

second segment having a second predetermined length and coupled to the first segment at 90° thereto and extending perpendicular to the first segment toward the rectangular outline;

third segment having a third predetermined length and coupled to the second segment at 90° thereto and extending along a first side of the rectangular outline away from the central feed point and terminating at a third side of the rectangular outline;

fourth segment having a fourth predetermined length coupled to the third segment at 90° thereto and extending perpendicularly to the third segment along the third side of the rectangular antenna outline and terminating proximate to the balun;

fifth segment having a fifth predetermined length coupled to the fourth segment at 90° thereto and extending perpendicularly to the fourth segment toward the central feed point; and the first through fifth predetermined lengths of the first through fifth segments total length equal to $\lambda_2/4$, where $\lambda_2$ is the resonant wavelength of the second dipole.

17. The antenna structure, as set forth in claim 12, wherein the third radiating element is a mirror image of the fourth radiating element along the center axis.

18. The antenna structure, as set forth in claim 12, wherein the antenna is symmetrical along the center axis.

19. The antenna structure, as set forth in claim 12, wherein the antenna structure comprises lengths of conductive stripline formed on a dielectric substrate.

20. The antenna structure, as set forth in claim 12, wherein the balun stripline segments form a generally continuous rectangular stripline coupled at one end to first and third radiating elements of the respective first and second dipoles, and second end to second and fourth radiating elements of the respective first and second dipoles.

21. The antenna structure, as set forth in claim 20, wherein the balun is located proximate to the first and second dipoles within the generally rectangular antenna outline.

22. The antenna structure, as set forth in claim 12, wherein the balun comprises:

a first balun channel section extending generally perpendicularly to the first and second dipole radiating elements from the common feed point; and a second balun channel section coupled to the first balun channel section, the second balun channel section extending generally parallel with the first and second dipole radiating elements.

23. A method of forming an antenna structure, comprising:

defining a generally rectangular outline having a width, W, and a length, L, and a center axis bisecting the length of the rectangular outline;

providing a central feed point lying on the center axis of the rectangular outline;

forming a first dipole coupled to the central feed point having first and second radiating elements extending opposite one another along the length of the rectangular outline for a total length less than L;

forming a second dipole coupled to the central feed point having third and fourth radiating elements extending opposite one another along the length of the rectangular outline for a length equal to L, the third and fourth radiating elements further comprising short perpendicular segments extending along the width of the rectangular outline operable to extend a total length of third and fourth radiating elements to a predetermined desired length, the third and fourth radiating elements generally staying within the rectangular outline; and forming a balun having stripline segments coupled to the central feed point and forming a narrow channel therebetween.

24. The method, as set forth in claim 23, further comprising forming first and second decoupling elements coupled respectively to third and fourth radiating elements.

25. The method, as set forth in claim 23, wherein forming the third radiating element of the second dipole comprises:

forming a first segment having a first predetermined length and extending from the central feed point parallel to and adjacent the first radiating element of the first dipole and terminating generally immediately beyond the first radiating element of the first dipole;

forming second segment having a second predetermined length and coupled to the first segment at 90° thereto and extending perpendicular to the first segment toward the rectangular outline;

forming a third segment having a third predetermined length and coupled to the second segment at 90° thereto and extending along a first side of the rectangular outline away from the central feed point and terminating at a second side of the rectangular outline;

forming a fourth segment having a fourth predetermined length coupled to the third segment at 90° thereto and extending perpendicularly to the third segment along the second side of the rectangular antenna outline and terminating proximate to the balun;

forming a fifth segment having a fifth predetermined length coupled to the fourth segment at 90° thereto and extending perpendicularly to the fourth segment toward the central feed point; and whereby the first through fifth predetermined lengths of the first through fifth segments total length equals to $\lambda_2/4$, where $\lambda_2$ is the resonant wavelength of the second dipole.

26. The method, as set forth in claim 23, wherein forming the fourth stripline radiating element of the second dipole comprises:

forming a first segment having a first predetermined length and extending from the central feed point parallel to and adjacent the first radiating element of the first dipole and terminating generally immediately beyond the first radiating element of the first dipole;

forming a second segment having a second predetermined length and coupled to the first segment at 90° thereto and extending perpendicular to the first segment toward the rectangular outline;

forming a third segment having a third predetermined length and coupled to the second segment at 90° thereto and extending along a first side of the rectangular outline away from the central feed point and terminating at a third side of the rectangular outline;

forming a fourth segment having a fourth predetermined length coupled to the third segment at 90° thereto and extending perpendicularly to the third segment along the third side of the rectangular antenna outline and terminating proximate to the balun;

forming a fifth segment having a fifth predetermined length coupled to the fourth segment at 90° thereto and extending perpendicularly to the fourth segment toward the central feed point; and whereby the first through fifth predetermined lengths of the first through fifth segments total length equals to $\lambda_2/4$, where $\lambda_2$ is the resonant wavelength of the second dipole.

27. The method, as set forth in claim 23, comprises forming the antenna structure using lengths of conductive stripline formed on a dielectric substrate.

28. The method, as set forth in claim 23, comprises etching a dielectric substrate to form lengths of conductive stripline for the antenna structure.

29. The method, as set forth in claim 23, wherein forming the balun comprises forming a generally continuous rectangular stripline coupled at one end to first and third radiating elements of the respective first and second dipoles, and second end to second and fourth radiating elements of the respective first and second dipoles.

30. The method, as set forth in claim 23, wherein forming a balun comprises:

forming a first balun channel section extending generally perpendicularly to the first and second dipole radiating elements from the common feed point; and forming a second balun channel section coupled to the first balun channel section, the second balun channel section extending generally parallel with the first and second dipole radiating elements.

* * * * *